United States Patent [19]

Germain

[11] Patent Number: 4,982,629

[45] Date of Patent: Jan. 8, 1991

[54] TOOL AND METHOD FOR REMOVING THE CAP OF AN OIL FILTER CARTRIDGE

[76] Inventor: Ronald T. Germain, 1429 Philmore, Lincoln Park, Mich. 48146

[21] Appl. No.: 233,288

[22] Filed: Aug. 17, 1988

Related U.S. Application Data

[63] Continuation of Ser. No. 65,044, Jun. 22, 1987, abandoned.

[51] Int. Cl.[5] ..... B25B 13/00

[52] U.S. Cl. ..... 81/176.1; 81/176.15; 81/176.3

[58] Field of Search ..... 81/176.1, 176.15, 176.3, 81/180.1, 185.2, 461, 176.2

[56] References Cited

U.S. PATENT DOCUMENTS 2,442,920 6/1948 DeVries ..... 81/176.1

3,043,171 7/1962 Lederer ..... 81/90

*Primary Examiner*—Frederick R. Schmidt

*Assistant Examiner*—M. Rachuba

*Attorney, Agent, or Firm*—Charles W. Chandler

[57] ABSTRACT

A tool for removing an oil filter cartridge from an engine has a body with a pair of openings. The openings accommodate the distance between a selected pair of openings in the oil filter cap. A pair of roll pins in the body are removably received in the body which also has a square central opening for receiving the shank of a wrench. The body is inserted in the interior of the oil filter cartridge adjacent the cap such that the pins are received in the oil filter openings, and the body then is turned with a wrench to turn the cartridge cap to remove it from the engine.

4 Claims, 1 Drawing Sheet

TOOL AND METHOD FOR REMOVING THE CAP OF AN OIL FILTER CARTRIDGE

This application is a continuation, of application Ser. No. 065,044, filed June 22, 1987, now abandoned.

BACKGROUND OF THE INVENTION

This invention is related to a tool for removing an oil filter cartridge from an engine. The cartridge case is partially removed so that the tool can be inserted inside the case, in contact with the cartridge end cap. A pair of roll pins received in the oil passages in the cap connect the tool to a wrench used for turning the tool and the cartridge.

Oil filter cartridges are used on engines for filtering the engine oil. A typical cartridge has a cap with a threaded opening for receiving a threaded, hollow nipple on the engine. The cap also has a series of preformed openings around the central opening for passing oil.

A problem common with replacing such cartridges is that they frequently become so tight on the threaded nipple as to be difficult to remove. Some special tools are employed for removing such cartridges such as devices used to pierce the cartridge case in order to turn the cartridge. An example of such prior art is illustrated in U.S. Pat. No. 3,043,171 which issued to Albert H. Lederer on July 10, 1962.

Lederer employs a plate-like circular body having several pointed pins mounted about a central opening. The central opening is adapted to receive a wrench. The user hammers the body and pins into the cartridge case so that the wrench can be employed for turning the case. The problem with such prior art devices is that the case is of a relatively lightweight metal and frequently distorts under stress without turning the cartridge cap.

DESCRIPTION OF THE PREFERRED EMBODIMENT

The preferred embodiment of the invention comprises a method and a tool for removing an oil filter cartridge from an engine in which the cartridge case is partially removed to expose the end cap. The preferred tool has a plate-like circular body with a pattern of preformed pin-receiving openings formed about a central square opening. The central opening is adapted to receive the shank of a wrench. The pattern of pin-receiving openings accommodates the oil passage patterns in conventional oil filter cartridges. The user inserts a pair of roll pins into a pair of openings selected according to the pattern of the cartridge cap, inserts the tool into the cartridge in a position adjacent the cap so the pins are received into the oil holes in the cap, and then by turning the wrench rotates the cap to remove it from the engine.

Still further objects and advantages of the invention will become readily apparent to those skilled in the art to which the invention pertains upon reference to the following detailed description.

DESCRIPTION OF THE DRAWINGS

The description refers to the accompanying drawing in which like reference characters refer to like parts throughout the several views, and in which.

DESCRIPTION OF THE PREFERRED EMBODIMENT

Figure 1:
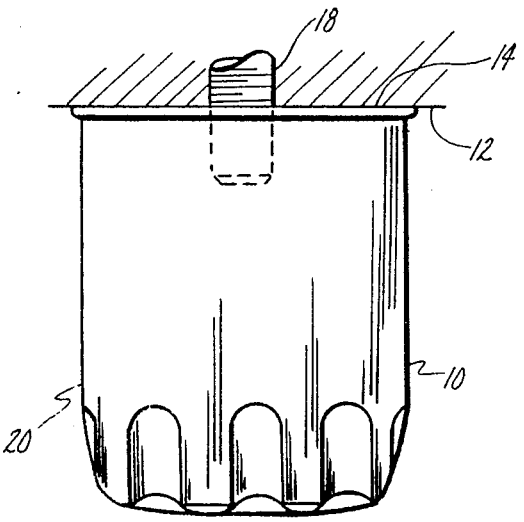
FIG. 1 is a view of a conventional oil filter cartridge mounted on a hollow threaded nipple of an engine.
Figure 2:
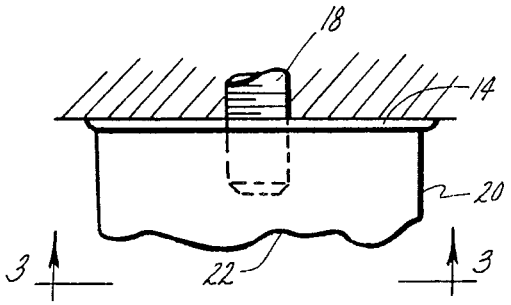
FIG. 2 illustrates the cartridge case removed closely adjacent the cartridge cap.

FIG. 1 illustrates a conventional oil filter cartridge 10 mounted on engine 12 in the usual manner. The cartridge has a cap 14 with a central opening 16 for receiving a threaded nipple 18. The cartridge has a relatively thin-walled case 20. Referring to FIG. 2, the case is preferably cut as at 22 to a position closely adjacent cap 14.

Figure 3:
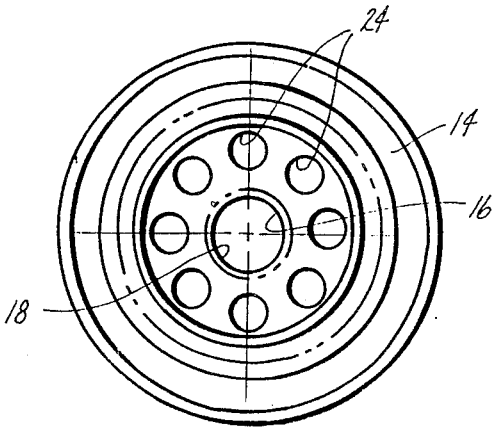
FIG. 3 is a view as seen along lines 3—3 of FIG. 2.
Figure 4:
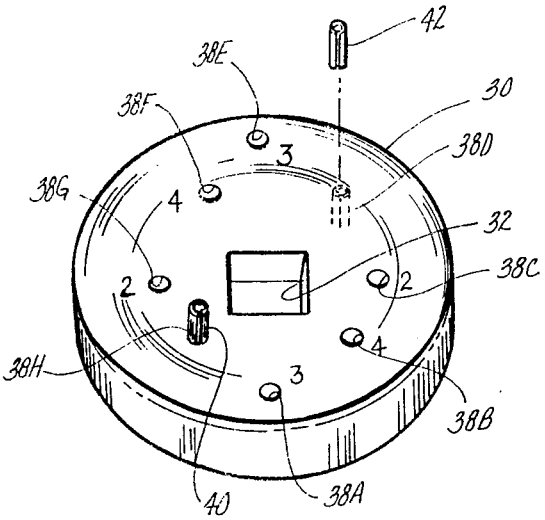
FIG. 4 is a perspective view of the preferred tool illustrating one of the roll pins removed from the pin-receiving opening.
Figure 5:
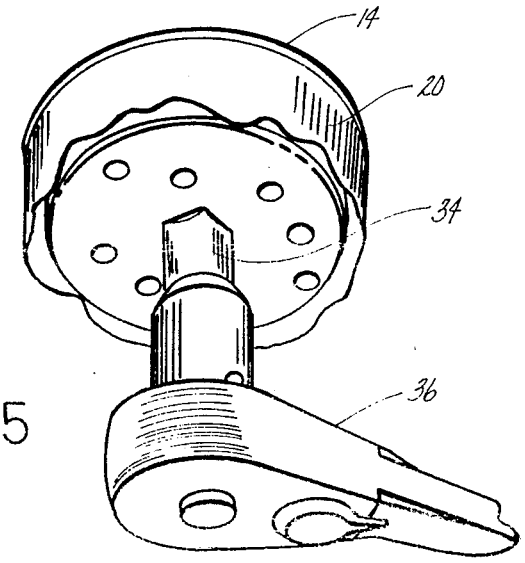
FIG. 5 illustrates the manner in which the tool is rotated by a wrench to remove the cartridge cap from the engine.

As illustrated in FIG. 3, cap 14 has a circular array of oil passages 24, formed about central opening 16.

The preferred tool comprises a circular body 30 having a diameter such that it can be received within the oil filter cartridge to a position closely adjacent cap 14. The body has a square, central opening 32 for receiving shank 34 of wrench 36. The body has a thickness sufficient to accommodate both the nipple and a wrench.

Different commercially-available oil filter cartridges have the oil passages 24 formed in various patterns. Body 30 has eight openings illustrated at 38A, 38B, 38C, 38D, 38E, 38F, 38G, and 38H. The location of openings 38A to 38H is chosen such that a pair of compressible, roll pins 40 and 42 may be received in a selected pair of the openings to accommodate the particular pattern of oil passages in the oil filter cartridge cap.

The roll pins have an uncompressed diameter slightly larger than the diameter of the pin-receiving openings so that the pins can be readily inserted or removed from their respective openings. The roll pins have a length such that they can be inserted in the body and still have a portion that extends beyond the body for insertion in the oil passages in the cartridge cap.

In use, the oil filter cartridge case is partially removed as illustrated in FIG. 2 The user can then view the openings 24 in the oil filter cap, or by being aware of the pattern of openings by virtue of the commercial name of the cartridge, insert the roll pins in the pin-receiving openings in the body to accommodate the oil passages in the cap. He then inserts the body to a position in which pins 40 and 42 are received in the cap openings, and by turning the wrench, turns and removes the cap from the engine.

Having described my invention, I claim:

1. For use with an engine having a threaded lubrication fitting and a filter cartridge having a cap with a threaded element having a central opening threadably engaged with the threaded fitting of the engine, the cap having a pair of spaced, existing, oil-passing openings disposed about the threaded element, the cartridge having a case at least partially removed to permit access to said oil-passing openings from the interior of the case;

a tool for removing the case from the lubrication fitting, said tool comprising:

a body receivable in the partially removed cartridge and the body having a plurality of radially spaced openings at varying diameters from the central opening, the body having a central opening for receiving the shank of a wrench for turning the body; and at least a pair of pins removably received in the pin-receiving openings of the body in positions in which a portion of each pin extends beyond the body and is received in an oil-passing opening in the cartridge cap, whereby the pins connect the body to the cap for turning both the cap and the body with the wrench to disengage the threaded element from the threaded fitting.

2. A tool useful for cooperating with a socket wrench for removal of a selected one of a variety of damaged, commercially-available oil filters from the threaded lubrication fitting of an engine, said selected filter having a cap with a plurality of openings for passing oil into and out of the filter cartridge, said tool comprising:

a tool body sized to be received within the damaged, selected oil filter adjacent the cap thereof;

the tool having a centrally disposed square aperture sized to closely receive the square end of a conventional socket wrench;

the tool body having a plurality of radially-spaced apertures positioned at varying diameters from the centrally disposed square aperture and positioned for alignment with existing oil-passing openings disposed in the caps of said variety of commercially-available oil filter cartridges;

at least two pins extending from selected, radially-spaced apertures in the tool body, in alignment with the existing oil-passing holes disposed in the cap of the selected damaged oil filter cartridge;

whereby suitable rotation of a conventional socket wrench whose square end is received in the square aperture in the tool body causes rotation of the tool body; and insertion of said pins in the existing oil-passing openings in the cap of the selected damaged oil filter cartridge unthreads the damaged oil filter cartridge from the threaded lubrication fitting of the engine.

3. A tool as defined in claim 2, in which said pins comprise roll pins.

4. In a tool useful for cooperating with a socket wrench for removal of a damaged commercially-available oil filter cartridge from the threaded lubrication fitting of an engine, said tool having a central square opening for receiving the square end of a conventional socket wrench for rotating the tool, said filter cartridge having a cap with a plurality of existing oil-passing openings for passing oil into and out of the cartridge, said tool having a plurality of radially-spaced apertures, the improvement comprising:

the tool having a size so as to be receivable in the damaged oil filter cartridge to a position adjacent the cap and a plurality of pins removable mounted in the radially spaced apertures thereof;

the radially-spaced apertures positioned at varying diameters from the central opening in the tool being located so as to be aligned with the existing oil-passing openings in said filter cartridge cap; and said pins being receivable in the existing oil-passing openings in the cap;

whereby rotation of the socket wrench causes rotation of the tool in the oil filter cartridge cap to unthread same from the threaded lubrication fitting of the engine.

* * * * *